US009099815B2

(12) United States Patent
Kashiwada et al.

(10) Patent No.: US 9,099,815 B2
(45) Date of Patent: Aug. 4, 2015

(54) DEVICE CONNECTOR WITH HEAT-RADIATING RUBBER HEAT BRIDGE BETWEEN HEAT GENERATING COMPONENT AND CONNECTOR HOUSING

(71) Applicant: Sumitomo Wiring Systems, Ltd., Yokkaichi, Mie (JP)

(72) Inventors: Tomokazu Kashiwada, Yokkaichi (JP); Hiroyuki Matsuoka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 8 days.

(21) Appl. No.: 14/080,846

(22) Filed: Nov. 15, 2013

(65) Prior Publication Data

US 2014/0148045 A1 May 29, 2014

(30) Foreign Application Priority Data

Nov. 28, 2012 (JP) ..... 2012-259792

(51) Int. Cl.

| | |
|---|---|
| ***H01R 13/00*** | (2006.01) |
| ***H01R 13/6592*** | (2011.01) |
| ***H01R 12/50*** | (2011.01) |
| ***H01R 13/688*** | (2011.01) |
| *H01R 13/512* | (2006.01) |
| *H01R 13/52* | (2006.01) |

(52) U.S. Cl.

CPC ..... *H01R 13/6592* (2013.01); *H01R 13/688* (2013.01); *H01R 23/7073* (2013.01); *H01R 13/512* (2013.01); *H01R 13/5202* (2013.01)

(58) Field of Classification Search

CPC ..... H01R 23/7073; H01R 23/4093; H01R 13/53; H01R 33/975; H01R 33/7664

USPC ..... 439/485–487

See application file for complete search history.

(56) References Cited

U.S. PATENT DOCUMENTS

| | | | | |
|---|---|---|---|---|
| 3,402,383 | A * | 9/1968 | Hilzen | 439/487 |
| 8,038,466 | B1 * | 10/2011 | Tai et al. | 439/485 |
| 8,425,256 | B2 | 4/2013 | Aoki et al. | |
| 2002/0123267 | A1 * | 9/2002 | Brooks | 439/621 |
| 2008/0096399 | A1 * | 4/2008 | Goh | 439/55 |
| 2010/0273347 | A1 * | 10/2010 | Tai et al. | 439/485 |
| 2012/0309232 | A1 * | 12/2012 | Darr et al. | 439/620.28 |

* cited by examiner

*Primary Examiner* — Chandrika Prasad

(74) *Attorney, Agent, or Firm* — Gerald E. Hespos; Michael J. Porco; Matthew T. Hespos

(57) ABSTRACT

A device connector that is to be connected to a device includes male terminals (21) to be connected to female terminals provided in the device and shield cables (90) are pulled out in a direction different from a connecting direction to the female terminals. An inner conductor (50) electrically conductively connects the male terminals (21) and the shield cables (90), and a fuse (30) is arranged in the inner conductor (50). A housing (10) made of resin includes an accommodation space (14) for accommodating the fuse (30) inside, and a heat radiating rubber portion (40) is disposed to fill up an air layer formed between the fuse (30) and the inner wall fuse mounting portion (18) of the accommodation space (14).

16 Claims, 13 Drawing Sheets

DEVICE CONNECTOR WITH HEAT-RADIATING RUBBER HEAT BRIDGE BETWEEN HEAT GENERATING COMPONENT AND CONNECTOR HOUSING

BACKGROUND

1. Field of the Invention

The invention relates to a device connector.

2. Description of the Related Art

U.S. Pat. No. 8,425,256 discloses a device connector with a built-in heat generating component, such as a capacitor. This device connector has a busbar for connecting wires from a device and from outside, a housing to be fit into a mounting hole of the device and a heat generating component accommodated in a receptacle of the housing. Connection terminals are provided on opposite ends of the heat generating component, and the heat generating component is mounted in the receptacle by screwing these connection terminals to ears of the busbar.

An air layer is present between the heat generating component and the inner wall of the receptacle and therefore heat generated in the heat generating component tends to stay in the receptacle. Thus, the connection terminals, the housing, the wires and the like may be damaged or otherwise affected by heat.

The invention was completed in view of the above situation and aims to improve dissipation of heat generated from a heat generating component.

SUMMARY OF THE INVENTION

The invention relates to a device connector to be connected to a device. The device connector comprises a device connecting portion to be connected to a device-side conductor provided in the device. An outer conductor is pulled out in a direction different from a connecting direction to the device-side conductor. An inner conductor electrically conductively connects the device-side conductor and the outer conductor. A heat generating component is arranged at an intermediate position of a conductive path of the inner conductor. The device connector also includes a housing with an accommodation space for accommodating the heat generating component therein. At least one heat radiating member is disposed to form a heat-bridge between the heat generating component and the inner wall of the accommodation space in the housing. Thus, heat generated from the heat generating component is dissipated easily so that the inner conductor, the device connecting portion and the housing are not damaged by heat.

The at least one heat radiating member is disposed to substantially fill an air layer between the heat generating component and the inner wall of the accommodation space. Thus, heat generated in the heat generating component is transferred to the housing via the heat radiating member and is dissipated easily so that the inner conductor, the device connecting portion, the housing are not damaged by heat.

At least one metal bracket may be fixed along an outer surface of the housing to at least partly cover the housing. The bracket may be fixed to the case of the device. Thus, heat transferred from the heat generating component to the housing is transferred to the case of the device via the bracket to enhance the heat radiation.

The heat radiating member may be a molded component made of rubber.

The heat radiating member preferably is held in close contact with an inner wall of the accommodation space to enclose the heat generating component. Thus, the heat radiating member formed separately from the housing merely has to be fit on the heat generating component. Thus, production cost can be reduced as compared with the case where the heat radiating member is formed by potting.

The heat radiating member may be formed with a slit by being cut from the inner wall of an accommodation hole for accommodating the heat generating component in a radially outward direction of the accommodation hole. The heat radiating member may be fit on the heat generating component with the slit opened. Accordingly, the heat radiating member is mounted easily on the heat generating component.

These and other features of the invention will become more apparent upon reading the following detailed description and accompanying drawings.

DETAILED DESCRIPTION OF THE PREFERRED EMBODIMENTS

Figure 1:
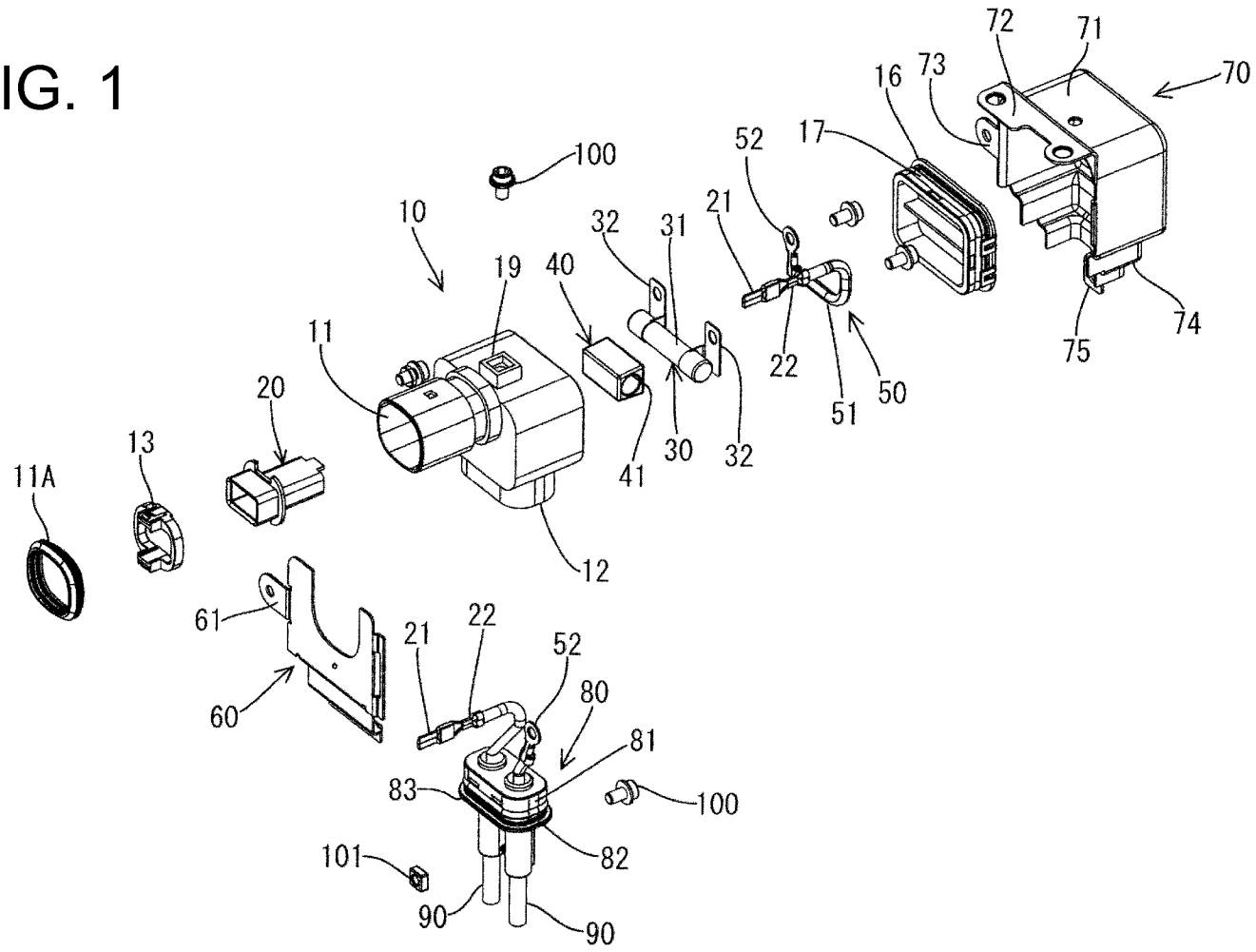
FIG. 1 is an exploded perspective view of a device connector.
Figure 2:
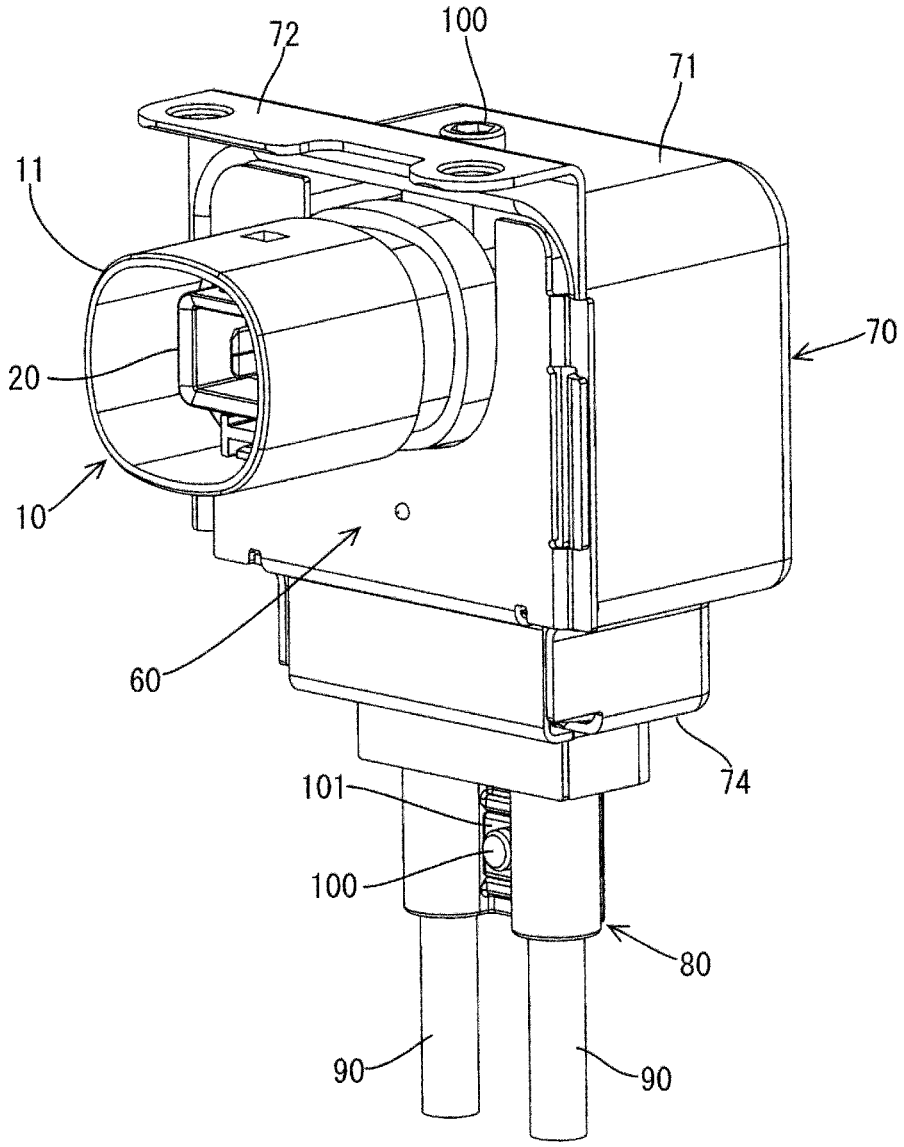
FIG. 2 is a front perspective view of the device connector from the front.

A device connector in accordance with the invention includes a housing 10 made e.g. of synthetic resin, a terminal accommodating portion 20, a fuse 30, a heat radiating rubber portion 40, an inner conductor 50, an electrically conductive front bracket 60, a rear bracket 70, a mold 80, one or more shield cables 90, etc. The device connector is fittable into a mounting hole of a case of a device.

Figure 11:
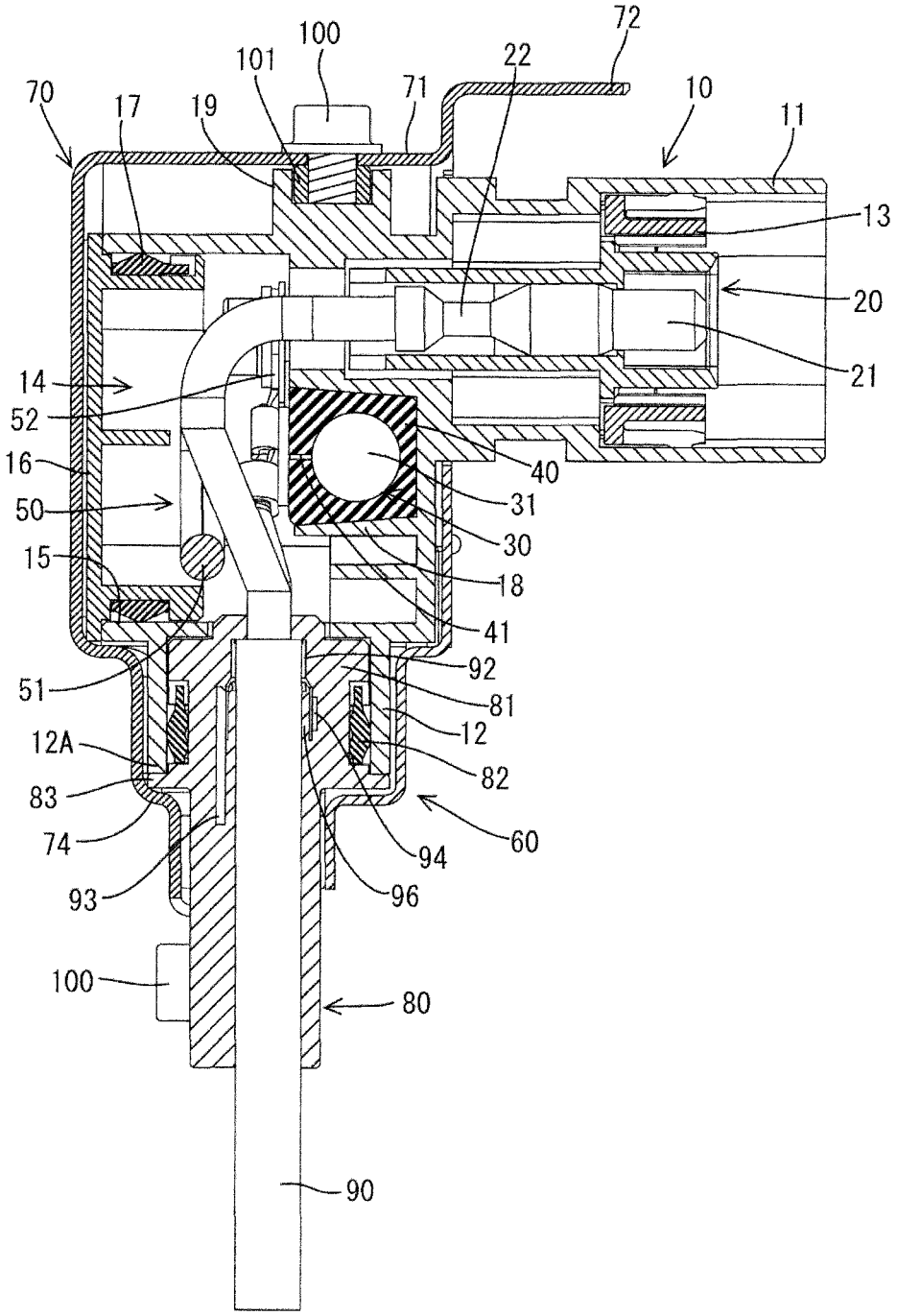
FIG. 11 is a section along C-C of FIG. 10.

The housing 10 includes a fitting 11 that can fit into the mounting hole of the device and a mounting portion 12 on which the mold portion 80 is to be mounted. A fitting direction of the fitting portion 11 into the mounting hole and a mounting direction of the mold portion 80 to the mounting portion 12 are substantially perpendicular. As shown in FIG. 11, the fitting 11 has a forwardly open receptacle and the mounting portion 12 has a downwardly open receptacle. The terminal accommodating portion 20 is accommodated into the fitting 11 from the front, and a holder 13 prevents detachment of the terminal accommodating portion 20. A resilient or rubber ring 11A is mounted on the outer peripheral surface of the fitting 11.

An accommodation space 14 is formed between the fitting 11 and the mounting portion 12 of the housing 10 and accommodates the inner conductor 50, the fuse 30, etc. inside. The accommodation space 14 communicates with the inner spaces of both the fitting portion 11 and the mounting portion 12. A service hole 15 is open on a rear wall forming the accommodation space 14 and is closed by a service cover 16. The service cover 16 includes a tubular portion to be fit into the service hole 15, and a rubber ring 17 is mounted on the outer peripheral surface of the tubular portion to prevent water from entering through the service hole 15 and into the accommodation space 14.

A fuse mounting portion 18 is formed in the accommodation space 14 in which the fuse 30 and the heat radiating rubber portion 40 are to be at least partly mounted. This fuse mounting portion 18 is open rearward and has an inclined inner surface formed to increase a vertical dimension toward the back. The fuse 30 particularly includes a substantially cylindrical fuse main body 31 and two fuse electrodes 32 formed respectively on opposite ends of the fuse main body 31. The fuse main body 31 has a known structure as a fuse and generates heat due to the flow of electricity.

The heat radiating rubber portion 40 is molded from a resilient material e.g. rubber and is mounted in the fuse mounting portion 18 while fit closely around the fuse main body 31. Further, the heat radiating rubber portion 40 closely contacts both the fuse main body 31 and the fuse mounting portion 18. Thus, the heat radiating rubber portion 40 fills out an air layer that would otherwise be formed between the fuse main body 31 and the fuse mounting portion 18. As a result, the heat radiating rubber portion 40 forms a heat-bridge between the fuse 30 and the housing 10 and has a higher thermal conductivity than air so that heat generated in the fuse main body 31 is transferred efficiently to the fuse mounting portion 18 via the heat radiating rubber portion 40. The heat transferred to the fuse mounting portion 18 is transferred to the rear bracket 70 from the outer surface of the housing 10 and further to the case of the device.

The heat radiating rubber portion 40 has a slit 41 formed by cutting the heat radiating rubber portion 40 radially out from the inner surface of an accommodation hole that accommodates the fuse main body 31. The slit 41 can be widened resiliently so that the heat radiating rubber portion 40 can be fit around the fuse main body 31 so that the fuse main body 31 is covered by the heat radiating rubber portion 40. Thus, the heat radiating rubber portion 40 is mounted easily on the fuse main body 31 merely by opening the slit 41.

Figure 8:
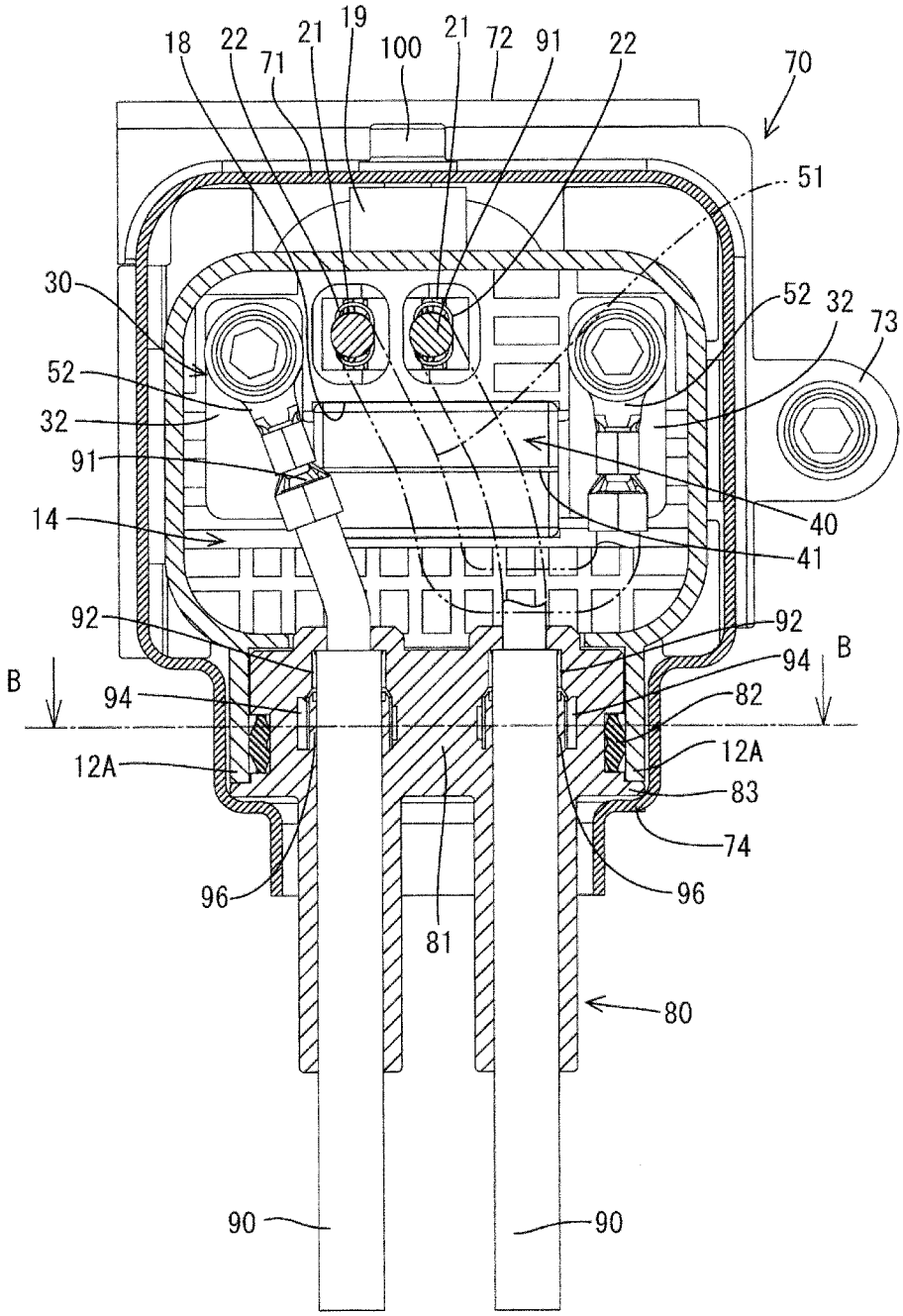
FIG. 8 is a section along A-A of FIG. 6.
Figure 10:
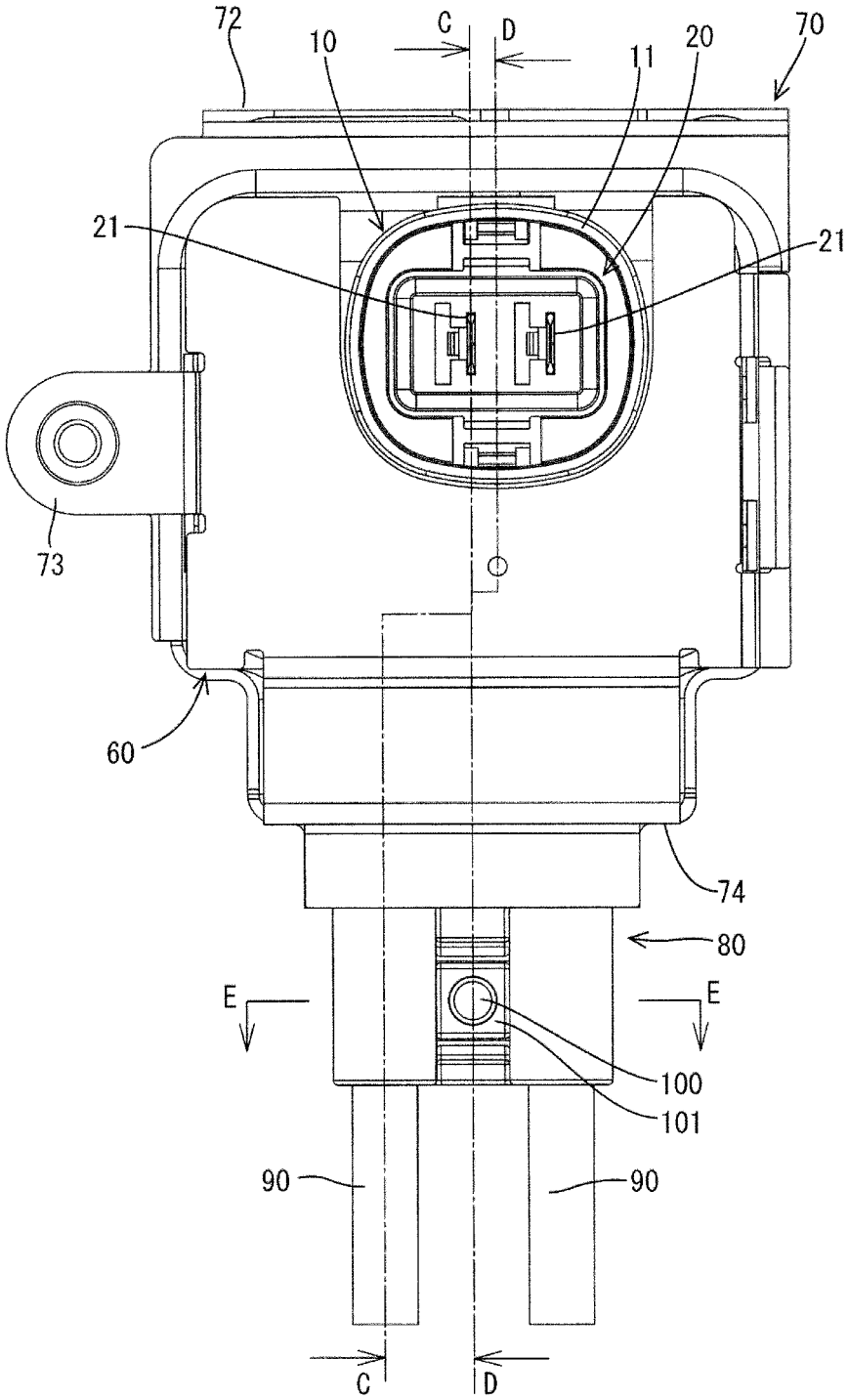
FIG. 10 is a front view of the device connector.

As shown in FIG. 11, male terminals 21 are accommodated in the terminal accommodating portion 20. The male terminals 21 can be connected to female terminals (not shown) provided in the device. Specifically, the male terminals 21 are tabs arranged laterally side by side and in a vertical orientation as shown in FIG. 10. One of the male terminals 21 is connected directly to one shield cable 90, as shown in FIG. 8, but the other male terminal 21 is connected to the other shield cable 90 via the inner conductor 50. The inner conductor 50 includes an inner wire 51 connected to an end of the male terminal 21 and two substantially round terminals 52 respectively connected to the fuse 30 and the fuse electrodes 32. In other words, the fuse 30 is arranged at an intermediate position of a conductive path of the inner conductor 50.

Figure 9:
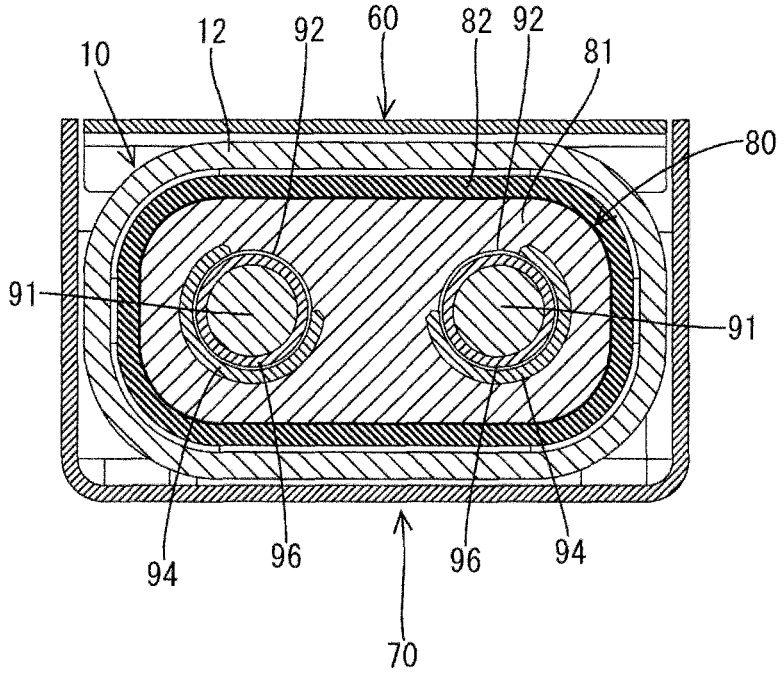
FIG. 9 is a section along B-B of FIG. 8.

The shield cable 90 is configured such that a braided wire 92 or other shield layer is arranged around a core 91 and insulating resin is arranged between the core 91 and the braided wire 92. Two shield cables 90 are arranged substantially adjacent to each other, and the respective braided wires 92 are connected together to a shield plate 93. Specifically, as shown in FIG. 9, an underlay ring 96 is to be mounted on the outer periphery of the shield cable 90, the braided wire 92 is arranged on the outer periphery of this underlay ring 96 and the braided wire 92 is caulked or sandwiched between a barrel piece 94 of the shield plate 93 and the underlay ring 96.

Figure 12:
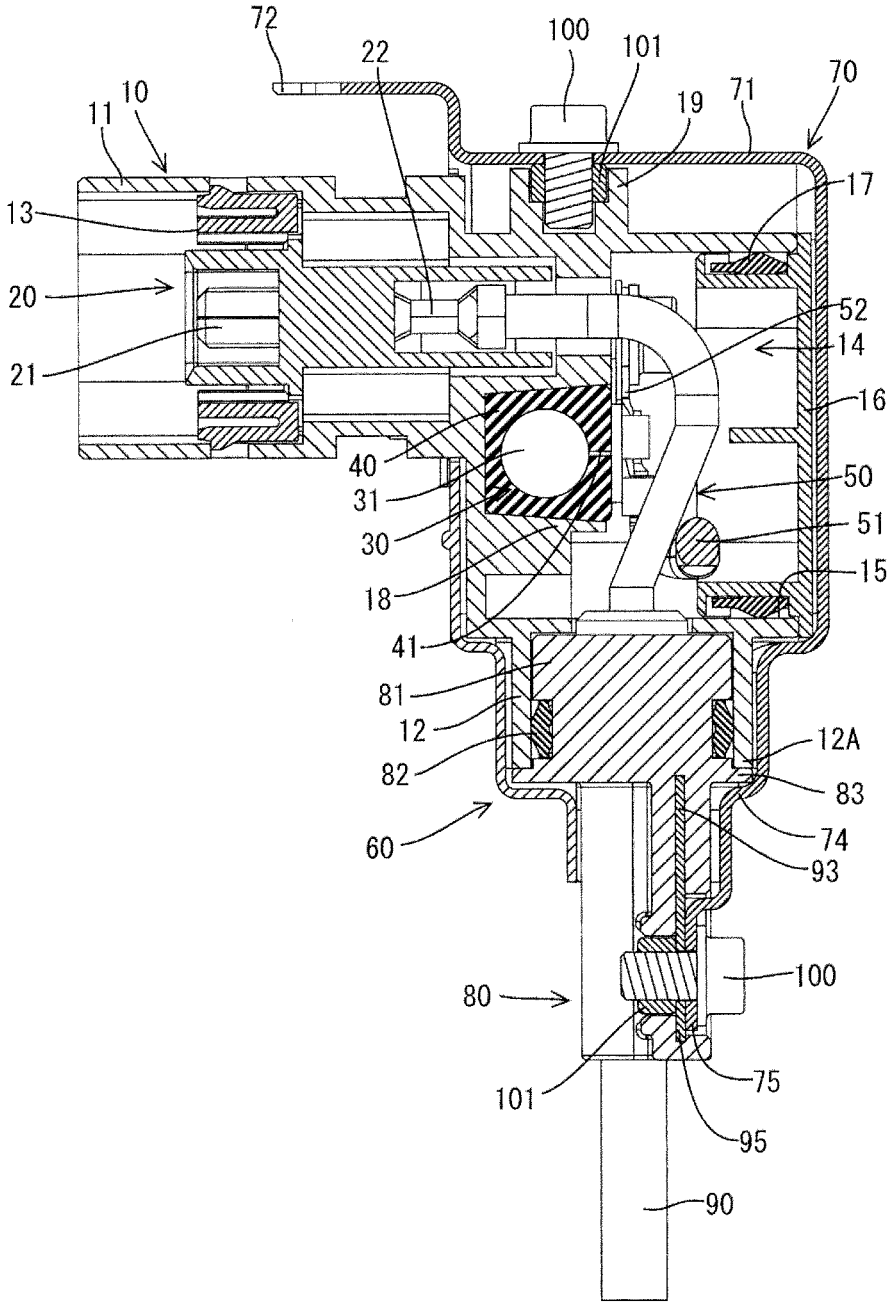
FIG. 12 is a section along D-D of FIG. 10.
Figure 13:
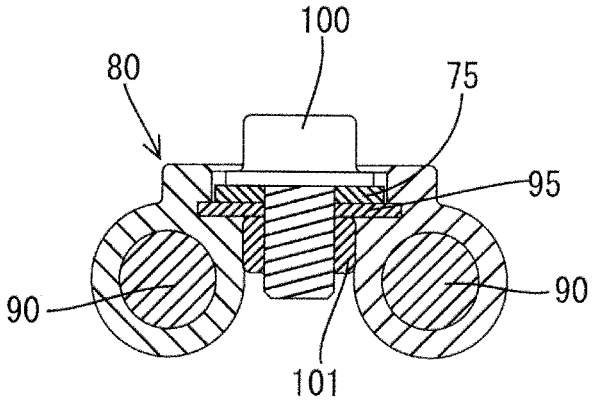
FIG. 13 is a section along E-E of FIG. 10.

The mold portion 80 is formed by molding the shield cables 90 and shield plate 93 with resin. The mold portion 80 has a shaft 81 that can be fit in the mounting portion 12 and a seal ring 82 is mounted on the outer periphery of a shaft 81. Thus, the seal ring 82 is sandwiched between the outer peripheral surface of the shaft 81 and the inner peripheral surface of the mounting portion 12 to prevent fluid from entering the housing 10 through the mounting portion 12. The barrel pieces 94 of the shield plate 93 are molded in the shaft 81. Further, as shown in FIG. 12, a bracket connecting portion 95 of the shield plate 93 is exposed below or from the shaft 81 and is at least partly between the shield cables 90.

As shown in FIG. 11, the rear bracket 70 is made of an electrically conductive metal plate and is mounted along the outer surface of the housing 10 to at least partly cover the housing 10 in a range from the rear surface to the upper surface. At least one boss 19 projects up on the upper surface of the housing 10 and a nut 101 is press-fit into the boss 19, and the rear bracket 70 is fixed to the housing 10 by tightening a bolt 100 while sandwiching a ceiling wall 71 of the rear bracket 70 between the bolt 100 and the nut 101. An attaching portion 72 projects forward from the front edge of the ceiling wall 71 of the rear bracket 70 and is to be bolt-fastened to the case of the device.

Figure 3:
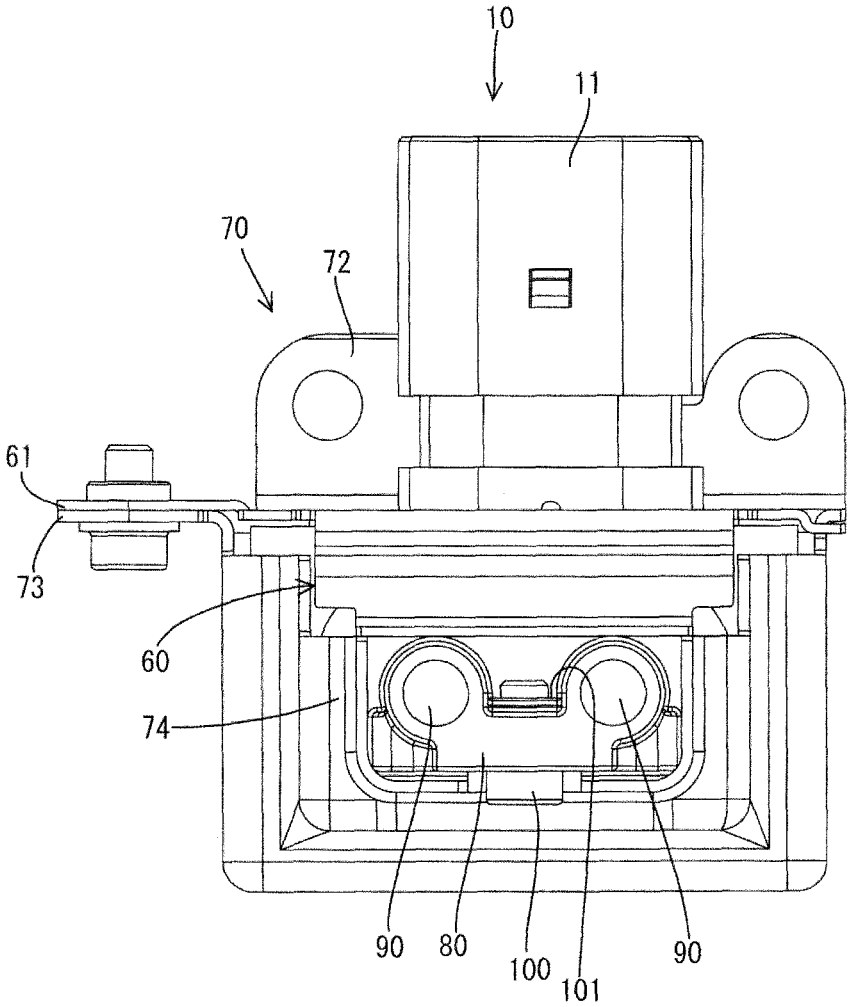
FIG. 3 is a bottom view of the device connector.
Figure 4:
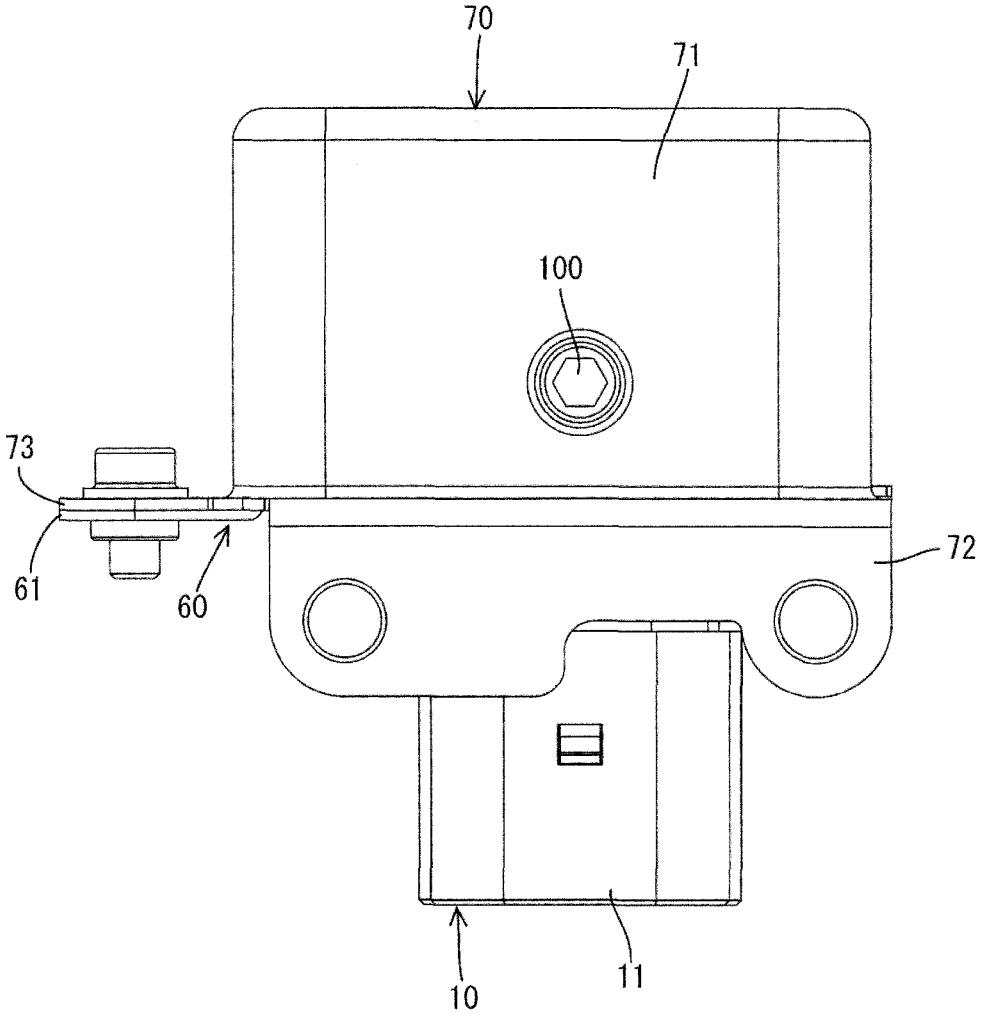
FIG. 4 is a plan view of the device connector.
Figure 5:
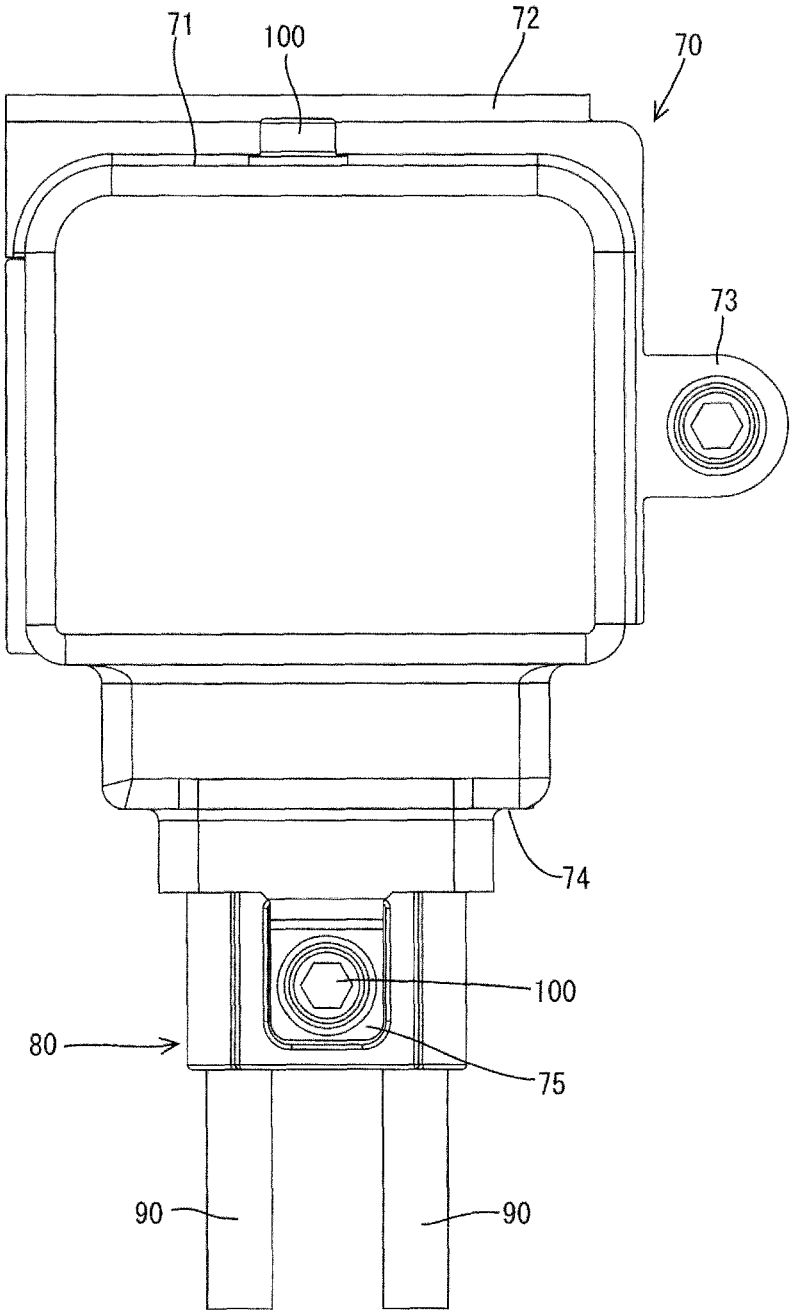
FIG. 5 is a rear view of the device connector.
Figure 6:
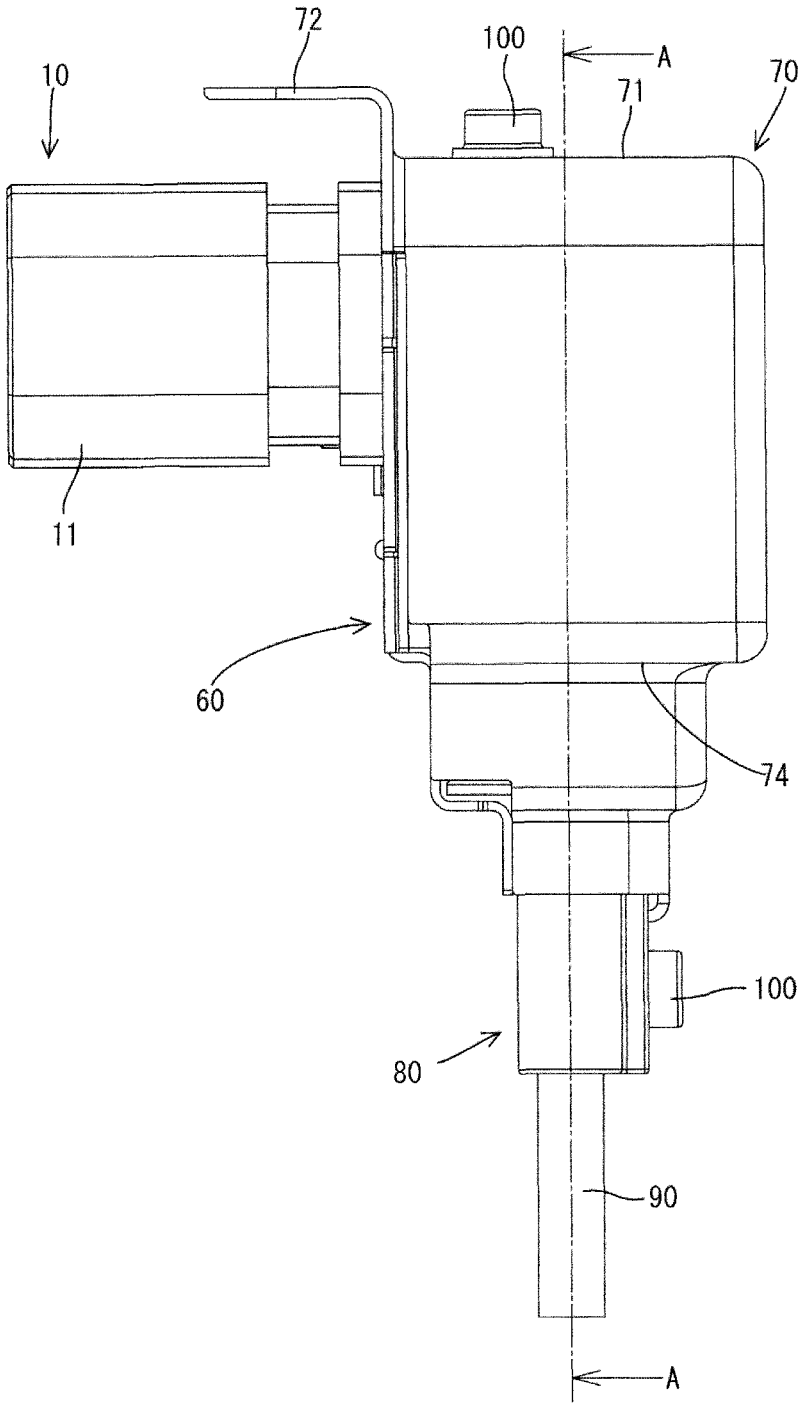
FIG. 6 is a right side view of the device connector
Figure 7:
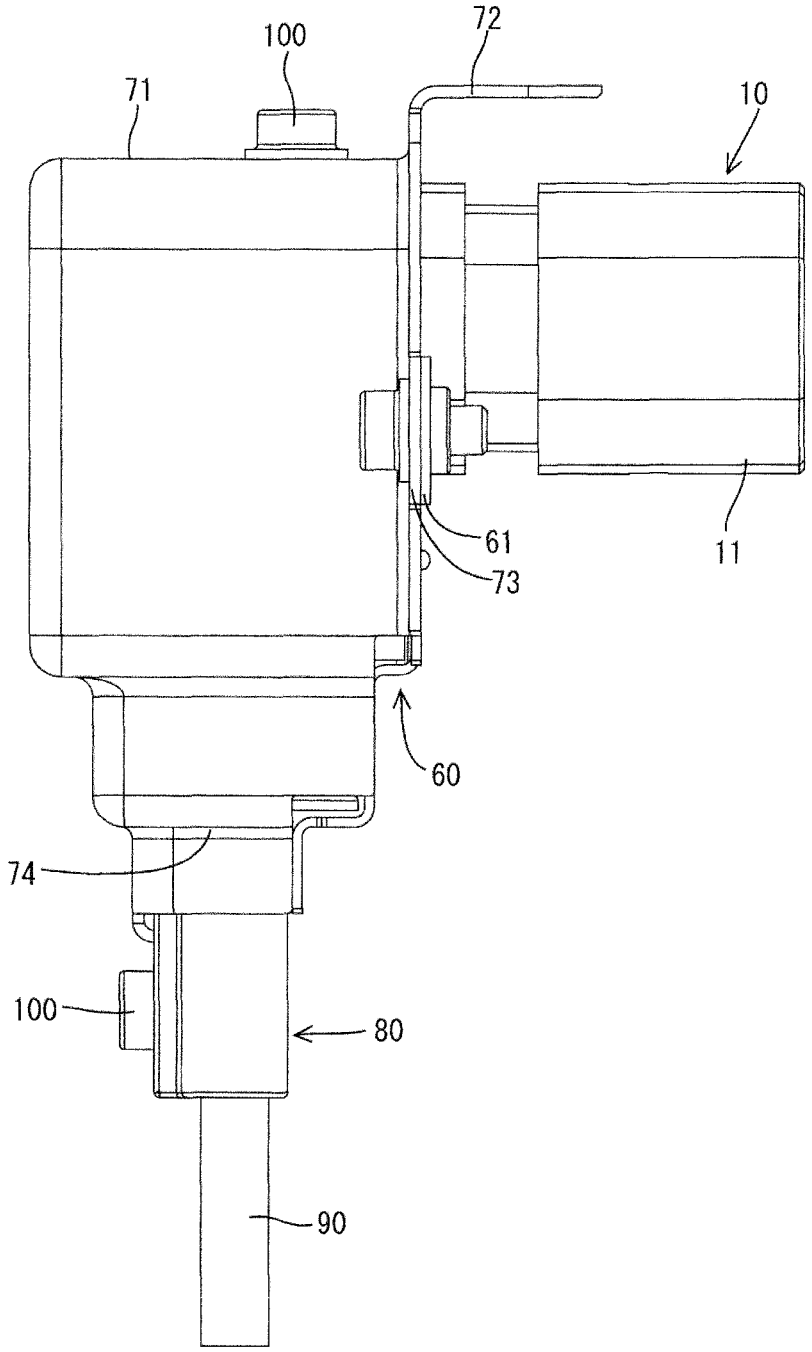
FIG. 7 is a left side view of the device connector.

The front bracket 60 includes a cut for the escape of the fitting 11, and is mounted substantially along the outer surface of the housing 10 to cover the front surface of the housing 10 excluding the fitting 11. As shown in FIGS. 3 and 4, the front bracket 60 and the rear bracket 70 each include a protrusion 61, 73 that protrudes laterally, and both brackets 60, 70 are connected to each other by bolt-fastening the protrusions 61, 73.

As shown in FIG. 11, an outer rib 83 is provided around the outer periphery of the mold portion 80 and contacts an opening edge 12A of the mounting portion 12 from below. Further, a part of the rear bracket 70 adjacent and below the mounting portion 12 is formed into a step 74 that contacts the outer rib 83 from below. The outer rib 83 is sandwiched vertically in a pull-out direction of the shield cables 90 between the opening edge 12A of the mounting portion 12 and the step 74. Thus, the mold portion 80 is fixed so as not to move vertically relative to the housing 10. Thus, any vibration transferred from the shield cables 90 in the pull-out direction of the shield cable 90 is blocked by the mold portion 80.

A fastening seat 75 is formed on a lower part of the rear bracket 70, as shown in FIG. 12, and is bolt-fastened to the bracket connecting portion 95. Further, a nut 101 is press-fit at a position of the mold portion 80 corresponding to the bracket connecting portion 95. The fastening seat 75 and the bracket connecting portion 95 are fastened while being sandwiched between a bolt 100 and the nut 101 to fix the mold portion 80 to the rear bracket 70. In this way, the mold portion 80 is fixed so as not to move relative to the housing 10, including in directions other than the pull-out direction of the shield cables 90. Simultaneously, the braided wires 92 are shield-connected to the case of the device via the shield plate 93 and the rear bracket 70 to improve shield performance.

The underlay ring 96 is mounted on the shield cables 90 in advance. The braided wires 92 then are exposed by applying peeling to ends of the shield cables 90 and are folded back to fit on the outer periphery of the underlay ring 96. The barrel pieces 94 of the shield plate 93 then are caulked and fixed to the braided wires 92. The shield cables 90 connected to the shield plate 93 then are set in a forming mold and molded with resin to form the mold portion 80. The seal ring 82 is mounted on the shaft 81 of the mold portion 80 and the shaft 81 is fitted into the mounting portion 12 of the housing 10.

On the other hand, the terminal accommodating portion 20 is mounted into the fitting 11 of the housing 10 from the front and the holder 13 is mounted therein from the front to fix the terminal accommodating portion 20 in the fitting 11. The slit 41 of the heat radiating rubber portion 40 is opened and the heat radiating rubber portion 40 is fit on the fuse main body 31 of the fuse 30. The resulting assembly then is pushed into the fuse mounting portion 18. In this way, the heat radiating rubber portion 40 is disposed to fill the air layer between the fuse main body 31 and the fuse mounting portion 18 and closely contacts both the fuse main body 31 and the fuse mounting portion 18.

Subsequently, as shown in FIG. 8, the core 91 of the right shield cable 90 is crimped, bent or folded to the barrel 22 of the male terminal 21, and the male terminal 21 is inserted into the terminal accommodating portion 20 from behind. On the other hand, the round terminal 52 is crimped to the core 91 of the left shield cable 90 and bolt-fastened to the left fuse electrode 32. Further, the male terminal 21 and the round terminal 52 are crimped respectively to opposite ends of the inner wire 51, the round terminal 52 is bolt-fastened to the right fuse electrode 32, and the male terminal 21 is inserted into the terminal accommodating portion 20 from behind. Thereafter, the service cover 16 is mounted at the service hole 15 to seal the accommodation space 14 of the housing 10.

The front bracket 60 is mounted on the front surface of the housing 10, the rear bracket 70 is mounted on the upper and rear surfaces of the housing 10, and the protrusions 61, 73 of the respective brackets 60, 70 are bolt-fastened. In this way, the brackets 60, 70 are formed into an integral bracket and mounted on the outer surfaces of the housing 10 excluding the fitting 11. Thus, heat generated in the fuse 30 is transferred to the case of the device via the heat radiating rubber portion 40, the housing 10 and the respective brackets 60, 70 and does not stay in the housing 10.

The rear bracket 70 is fixed to the housing 10 by tightening the bolt 100 into the nut 101 press-fit into the boss 19 of the housing 10, and the fastening seat 75 and the bracket connecting portion 95 are fixed conductively by tightening the bolt 10 into the nut 101. The fitting 11 of the housing 10 then is inserted into the mounting hole in the case of the device. The attaching portion 72 of the rear bracket 70 then is bolt-fastened to the case of the device so that the rear bracket 70 and the case are fixed electrically conductively. Thus, vibration transferred from the shield cables 90 is blocked by the mold portion 80 and does not affect contact portions of the male terminals 21 and the female terminals.

As described above, no air layer is formed between the fuse 30 and the accommodation space 14. Thus, heat generated in the fuse 30 is transferred to the housing 10 via the heat radiating rubber portion 40. Thus, the heat generated from the fuse 30 is dissipate and will not affect the inner conductor 50, the contacts of the male terminals 21 and the female terminals, the housing 10 and the like.

The brackets 60, 70 are made of metal and fixed along the outer surfaces of the housing 10 to cover at least part of the housing 10. Thus, heat transferred from the fuse 30 to the housing 10 is transferred to the case of the device via the brackets 60, 70, and the heat radiation property can be enhanced further.

The heat radiating rubber portion 40 is a molded component made of resilient material and closely contacts the inner wall of the accommodation space 14 when fit to enclose the fuse 30. The heat radiating rubber portion 40 is formed separately from the housing 10 and only has to be fit on the fuse 30. Thus, production cost can be reduced as compared with the case where a heat radiating member is formed by potting.

The heat radiating rubber portion 40 is formed with the slit 41 by being cut from the inner wall of the accommodation hole for accommodating the fuse 30 in the radially outward direction of the accommodation hole, and the heat radiating rubber portion 40 may be enlarged and fit on the fuse 30 with this slit 41 opened. According to such a configuration, the heat radiating rubber portion 40 is mounted easily on the fuse 30.

The invention is not limited to the above described embodiment. For example, the following embodiments also are included in the scope of the invention.

Although the fuse 30 is illustrated as a heat generating component in the above embodiment, a thermistor, or any other electric/electronic component having a heat dissipation may be used as a heat generating component.

The heat radiating rubber portion 40 is illustrated as a heat radiating member in the above embodiment. However, the fuse 30 may be embedded in resin using a potting agent.

Although the housing 10 is fixed to the case of the device using the brackets 60, 70 in the above embodiment, the housing 10 may be bolt-fastened directly to the case of the device according to the invention.

What is claimed is:

1. A device connector, comprising:

a device connecting terminal aligned in a connecting direction;

an outer conductor pulled out in a direction different from the connecting direction;

an inner conductor electrically conductively connecting the outer conductor and the device connecting terminal;

a heat generating component arranged at an intermediate position of a conductive path of the inner conductor;

a housing including an accommodation space for accommodating the heat generating component and having an outer wall adjacent the accommodation space; and at least one heat radiating member formed from a heat radiating rubber having higher thermal conductivity than air and substantially surrounding and resiliently engaging the heat generating component, the heat-radiating member being spaced from the inner conductor and disposed to form a heat-bridge that fills a space between the heat generating component and the outer wall of the housing adjacent the accommodation space.

2. The device connector of claim 1, further comprising at least one bracket made of metal and fixed along the outer wall of the housing to at least partly cover the housing at a position on the outer wall opposite the heat radiating member.

3. The device connector of claim 1, wherein the heat radiating member is a molded component.

4. The device connector of claim 3, wherein the heat radiating member is formed with a slit by being cut from the inner wall of an accommodation hole for accommodating the heat generating component in a radially outward direction of the accommodation hole to an outer surface of the heat radiating member so that the heat radiating member is fit on the heat generating component with the slit opened and then closes resiliently to engage the heat generating component.

5. The device connector of claim 4, wherein the heat generating component is a fuse with a cylindrical body, the accommodation hole being substantially cylindrical and extending through the heat radiating member from a first longitudinal end to a second longitudinal end.

6. The device connector of claim 4, wherein the outer surface of the heat radiating component is in face-to-face contact with the outer wall of the housing.

7. The device connector of claim 6, wherein the outer surface of the heat radiating component is a first outer surface, the heat radiating component having at least one additional outer surface in face-to-face contact with at least one additional wall of the housing.

8. The device connector of claim 4, wherein the outer surface of the heat radiating component is substantially planar.

9. An electrical connector, comprising:

a housing including outer walls forming an accommodation space;

at least one conductor passing through the accommodation space;

a heat generating component in the accommodation space and spaced from both the conductor and the outer wall of the housing; and at least one heat radiating member formed from a heat radiating rubber having higher thermal conductivity than air and being in surrounding resilient engagement with the heat generating component, the heat radiating member being spaced from the conductor and filling a space between the heat generating component and the outer wall of the housing to form a heat-bridge for directing heat from the heat generating component away from the conductor and outward from the outer wall of the housing.

10. The connector of claim 9, further comprising at least one bracket made of metal and fixed along the outer wall of the housing to at least partly cover the housing at a position on the outer wall opposite the heat radiating member.

11. The device connector of claim 9, wherein the heat radiating member is a molded component.

12. The connector of claim 11, wherein the heat radiating member is formed with a slit by being cut from the inner wall of an accommodation hole for accommodating the heat generating component in a radially outward direction of the accommodation hole to an outer surface of the heat radiating member so that the heat radiating member is fit on the heat generating component with the slit opened and then closes resiliently to engage the heat generating component.

13. The connector of claim 12, wherein the heat generating component is a fuse with a cylindrical body, the accommodation hole being substantially cylindrical and extending through the heat radiating member from a first longitudinal end to a second longitudinal end.

14. The device connector of claim 9, wherein the outer surface of the heat radiating component is in face-to-face contact with the outer wall of the housing.

15. The connector of claim 14, wherein the outer surface of the heat radiating component is a first outer surface, the heat radiating component having at least one additional outer surface in face-to-face contact with at least one additional wall of the housing.

16. The connector of claim 14, wherein the outer surface of the heat radiating component is substantially planar.

* * * * *